US005904313A

United States Patent [19]

Perret et al.

[11] Patent Number: 5,904,313

[45] Date of Patent: May 18, 1999

[54] TURNTABLE COILER FOR REELING METAL STRIPS

[75] Inventors: Jean Perret, Montbrison; Michel Chevet, Saint-Etienne; Rémi Perenon, Villars, all of France

[73] Assignee: Kvaerner Metals Clecim, Paris La Defense Cedex, France

[21] Appl. No.: 08/873,273

[22] Filed: Jun. 11, 1997

[30] Foreign Application Priority Data

Jun. 14, 1996 [FR] France ..... 96 07461

[51] Int. Cl.[6] ..... B65H 19/22; B65H 18/08; B65H 71/00

[52] U.S. Cl. ..... 242/533.6; 242/533.4; 242/539; 242/909

[58] Field of Search ..... 242/533.4, 533.5, 242/533.6, 559.2, 909, 539

[56] References Cited

U.S. PATENT DOCUMENTS

| | | | |
|---|---|---|---|
| 2,321,646 | 6/1943 | Blodgett | 242/362.1 |
| 3,699,880 | 10/1972 | Nuckel | 100/7 |
| 5,695,150 | 12/1997 | Chevet et al. | 242/533.6 |

FOREIGN PATENT DOCUMENTS 61-124478 6/1986 Japan .

OTHER PUBLICATIONS

FR 96/07461 Preliminary Search Report.

*Primary Examiner*—John Q. Nguyen

*Attorney, Agent, or Firm*—Pollock, Vande Sande & Amemick

[57] ABSTRACT

A turntable coiler for reeling a strip product, comprising a frame mounted rotatably around a central axis, and at least two fixed cantilever reeling mandrels, each in the alignment of a rotation shaft mounted rotatably on two spaced centering bearings. Each mandrel is connected to a motor comprising a rotor fastened to the shaft of the mandrel, and a stator. Each mandrel, its rotation shaft with both bearings and the motor form a motor-mandrel assembly mounted in an independent chassis on which are fastened the stator of the motor and both centering bearings of the shaft carrying the rotor, and the rotary frame is provided with at least two supporting devices, connected to removable bolts for centering and fastening the chassis of the motor-mandrel assembly, in a position for which the reeling axis defined by the bearings is parallel to the central axis, and each motor-mandrel assembly thus constitutes an interchangeable module.

20 Claims, 6 Drawing Sheets

TURNTABLE COILER FOR REELING METAL STRIPS

FIELD OF THE INVENTION

This invention relates to a turntable coiler for reeling a strip product, usable especially in a rolling and processing unit for metal strips.

BACKGROUND OF THE INVENTION

A production unit of metal strips comprises various pieces of equipment, notably for rolling, dressing, pickling or other treatments. At the exit of a given section of the unit, the strip must, generally, be reeled onto a coil, to facilitate its transportation to another section or any other location in view of its use.

To this end, a coiler comprising at least one mandrel brought into rotation around its axis and on which the strip is reeled to form a coil, is used. The mandrel is provided, according to well-known embodiments, with retractable expansion means, enabling the coiler to be removed upon completion of the reeling sequence, and is generally combined to appended devices such as, for instance, a belt winder facilitating the beginning of the reeling sequence, as well as means for removing the reeled coils.

In certain improved units, especially those working in continuous flow, such as coupled rolling mills or lines, it is necessary to have outlet equipment especially suited to large production capacities.

Particularly, as soon as a coil has reached the desired sizes, the strip must be sheared off and engaged immediately onto another coiler. A strip accumulator permits the rolling process to continue during the replacement of the coiler, but the time necessary for this operation must obviously, remain as short as possible.

Usually, such an installation comprises thus two independent coilers, each having a belt reeler and a carriage for removing the coils. The passage of the product, after shearing, from one coiler to the other, is ensured by a junction system. Such a lay-out is quite cumbersome and expensive, notably further to the infrastructure cost called for.

In order to reduce the space requirements of the coiling unit, it has already been suggested to use, instead of the two independent coilers, a single apparatus comprising two reeling mandrels mounted on a drum-shaped rotary frame, mounted rotatably around a center axis, each mandrel being fastened in cantilever fashion on a driving shaft mounted rotatably on the drum around an axis parallel to the center axis of the latter.

It is thus possible to index successively one mandrel or the other in a position to reel the strip, by simple rotation of the drum around its axis (DEA-3346219, JP-A-61-124478).

Such a coiler, called "turntable coiler", calls for a single reeler and a single removing carriage for the coils, which reduces significantly the infrastructure cost. Moreover, as the engagement geometry of the strips is constant, the junction device is not necessary any longer.

However, to enable positioning of either of the mandrels and of the separate control unit for the rotation of the mandrel, being in reeling position, the existing installations of this type exhibit quite complex mechanisms and require numerous gears, transmission shafts, bearings, clutches, claw couplings, and the like.

In order to simplify the mechanical layouts, it has been suggested, in JP-A-61.124478, to connect to each mandrel an electric motor, comprising a rotor turning inside a stator, the latter being fixed on the drum and the rotor turning together with the driving shaft of the mandrel.

Thus, each driving motor of a mandrel needs simply to be connected to an electrical power supply, by a power supply circuit which can advantageously pass through the center rotation shaft of the drum, so that selective control for the rotation of one mandrel or the other is performed easily.

Such a layout enables the withdrawal of the driving mechanisms of both mandrels while replacing them with autonomous motors. However, the whole assembly remains rather heavy and cumbersome and overheating of the electric motors located inside the drum may be expected.

SUMMARY OF THE INVENTION

The invention relates to a new layout which is especially simple and lightweight which enables considerable simplification of the installation of the mandrels as well as of the maintenance of the driving assembly.

The invention relates, generally, to a turntable coiler for reeling a strip product on one of at least two reeling mandrels, comprising a rotary frame mounted rotatably on a fixed bracket around a central axis, at least two reeling mandrels fixed in cantilever fashion, each in the alignment of a rotation shaft mounted rotatably on two spaced bearings supported by the rotary frame and defining a reeling axis of the mandrel parallel to the central axis of the frame and eccentric with respect to the latter, at least two motors each connected to a mandrel and each comprising a rotor and a stator fixed in rotation, respectively on the shaft of the mandrel and on the rotary frame and centered around its axis, means for controlling the rotation of the frame around its axis for selective indexing of one of the mandrels in reeling position, and means to supply each motor with power to drive the corresponding mandrel According to the invention, each motor connected to a mandrel is mounted in an independent chassis on which are mounted the stator of the motor and both centering bearings of the rotation shaft carrying the rotor and the mandrel, and the rotary frame is provided with at least two supporting devices, each with a motor-mandrel assembly comprising a mandrel, its rotation shaft and the connected motor. Each supporting device is connected to removable means for centering and fastening the chassis of the motor-mandrel assembly in a position in which the reeling axis defined by the bearings is parallel to the central axis, and each motor-mandrel assembly constitutes an interchangeable module.

According to a preferred embodiment, the chassis of each motor-mandrel assembly comprises a base which is substantially planar and able to be applied onto a corresponding platform provided on the rotary frame and constituting the supporting device of the corresponding motor-mandrel assembly. The base and the platform are provided with combined centering and fastening devices, which can be disconnected from one another. Preferably, the rotary frame comprises at least two fastening platforms, each with a motor-mandrel assembly, which are placed symmetrically on either side of a shaft mounted pivotably on the fixed bracket and defining the central axis of the frame.

Preferably, the central shaft is provided, at its end facing the side on which the mandrels are located, with a rotary bearing flange containing a circular track resting on at least two spaced rollers. The other end of the central shaft is centered in a bearing mounted on a fixed bracket, whereby the relative levels of both rollers and of the bearing are such that the axis of the central shaft is substantially horizontal.

According to another particularly advantageous feature, the bearing flange is provided with at least two indentations each connected to a supporting device and each of a breadth at least sufficient to allow passage of a mandrel when fitting a motor-mandrel assembly to the supporting device and the circular bearing crown comprises at least two fixed sectors provided on the bearing flange between the indentations and at least two mobile sectors provided each on the chassis of a motor-mandrel assembly. The fixed and mobile sectors exhibit the same curving radius in order to build a continuous circular bearing track upon completion of the fitting of the motor-mandrel assemblies on the corresponding supporting devices.

The chassis of the motor-mandrel assembly must be reinforced sufficiently to maintain of the stator, the rotation shaft and the cantilever mandrel in order to build a rigid structure able to provide the resistance of the assembly.

Preferably, each rotation shaft can be provided with a short centering cone enabling quick assembly and disassembly of the mandrel and allowing use of mandrels diameters and of various technologies.

Moreover, the rotor of the motor can advantageously be shrunk oil a sleeve inserted onto the rotation shaft and attached to the latter by ribs for transmission of the motor torque. However, in certain applications, the rotor can be shrunk directly on the rotation shaft.

BRIEF DESCRIPTION OF THE DRAWINGS

The invention will be better understood using the following description of particular embodiments, given by way of example and represented in the appended drawings.

DETAILED DESCRIPTION OF PREFERRED EMBODIMENT

Figure 1:
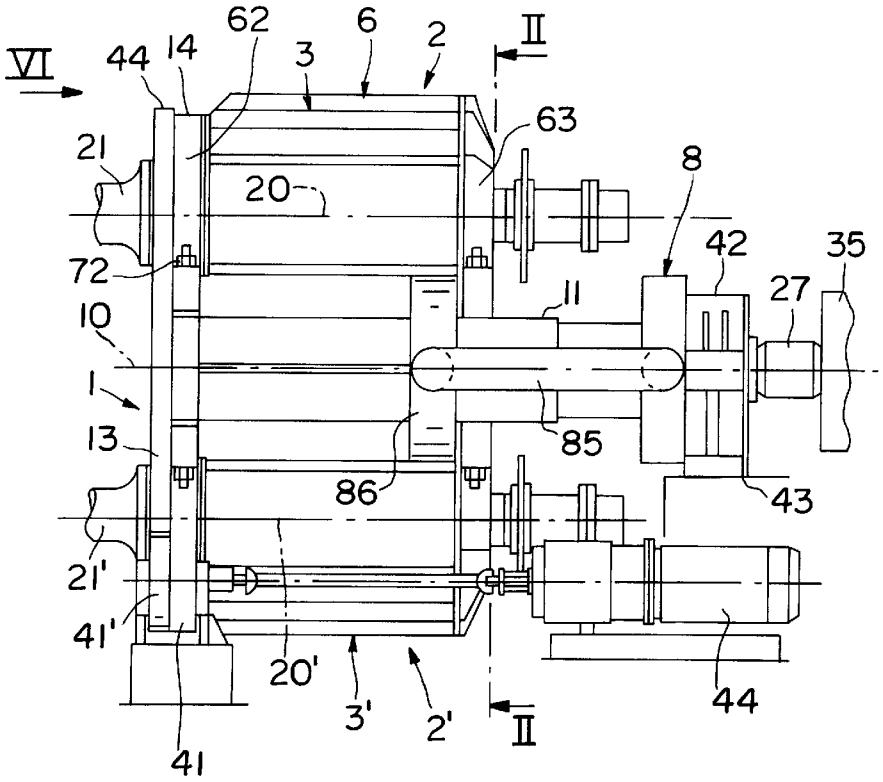
FIG. 1 is a side view of the coiler assembly according to the invention after partial removal of the mandrels.
Figure 2:
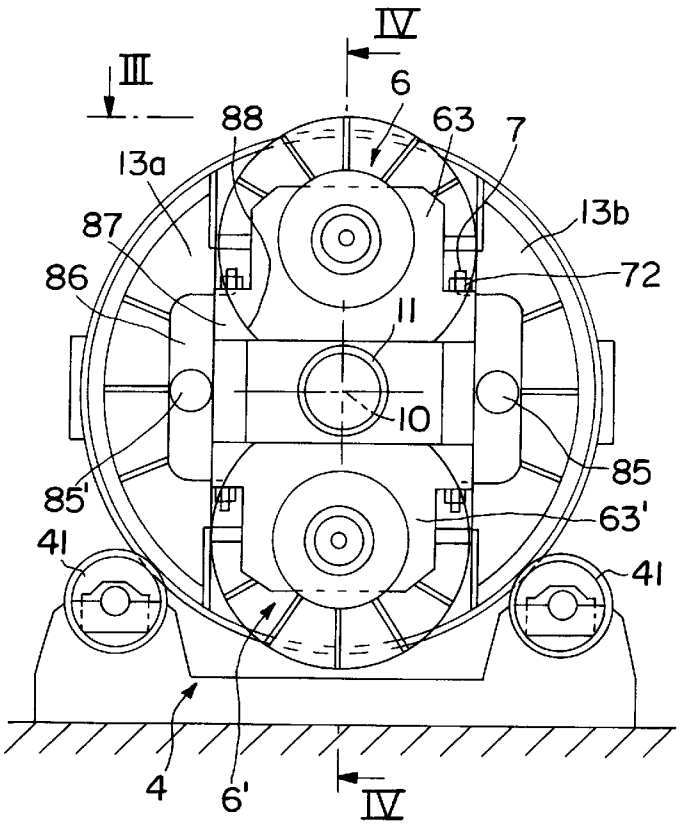
FIG. 2 is a real view of the coiler, in a cross section along line II—II of FIG. 1.

FIGS. 1 and 2 are side and rear views of the entire coiling unit according to the invention comprising a rotary frame 1 mounted rotatably around an axis 10, normally horizontal, and carrying, in the example represented, two motor-mandrel assemblies 2, 2' fixed on the rotary frame 1, symmetrically on either side of the rotation axis 10.

Each motor-mandrel assembly 2, 2' comprises a motor 3, 3' for driving into rotation a shaft 5, 5' centered on an axis 20, 20' parallel to the central axis 10 of the frame and on which has been mounted in cantilever fashion a mandrel which is represented partially on FIG. 1.

Figure 7:
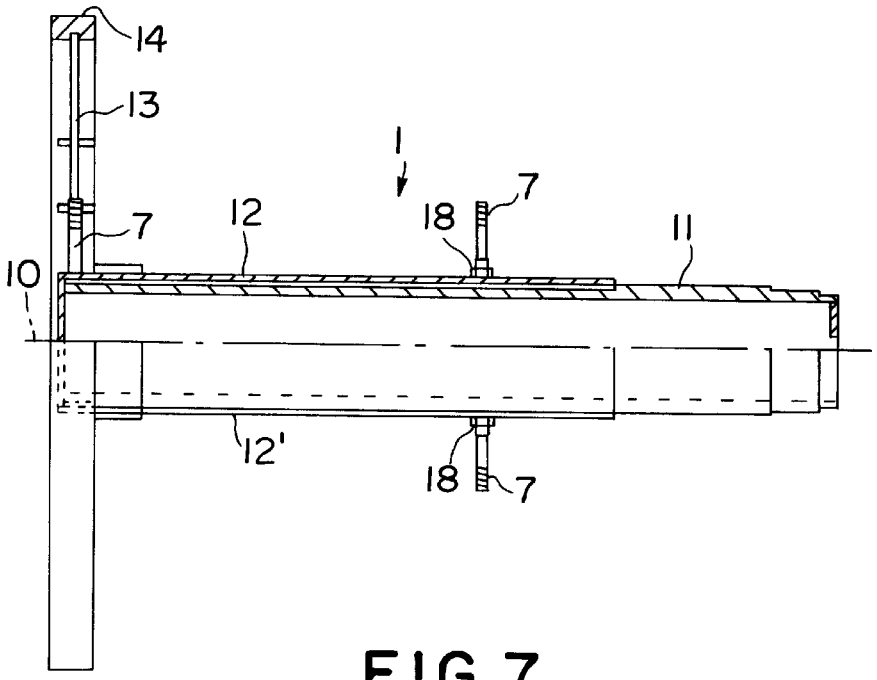
FIGS. 7, 8 and 9 represent the rotary frame, respectively in an side view, a top plan view and a front elevation view.
Figure 8:
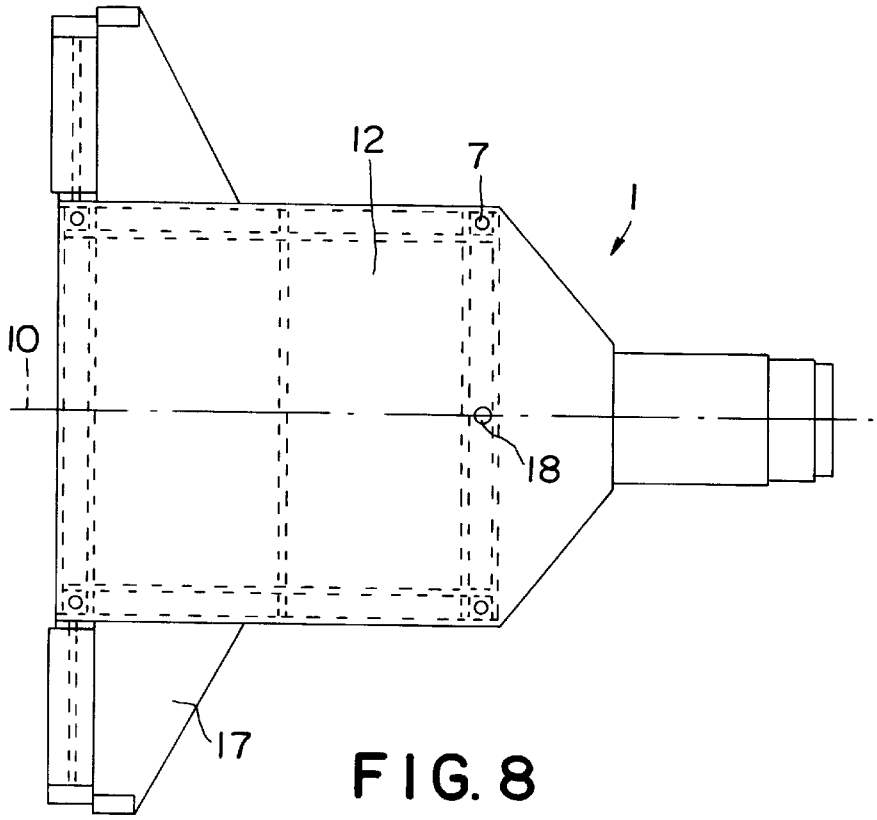
Figure 9:
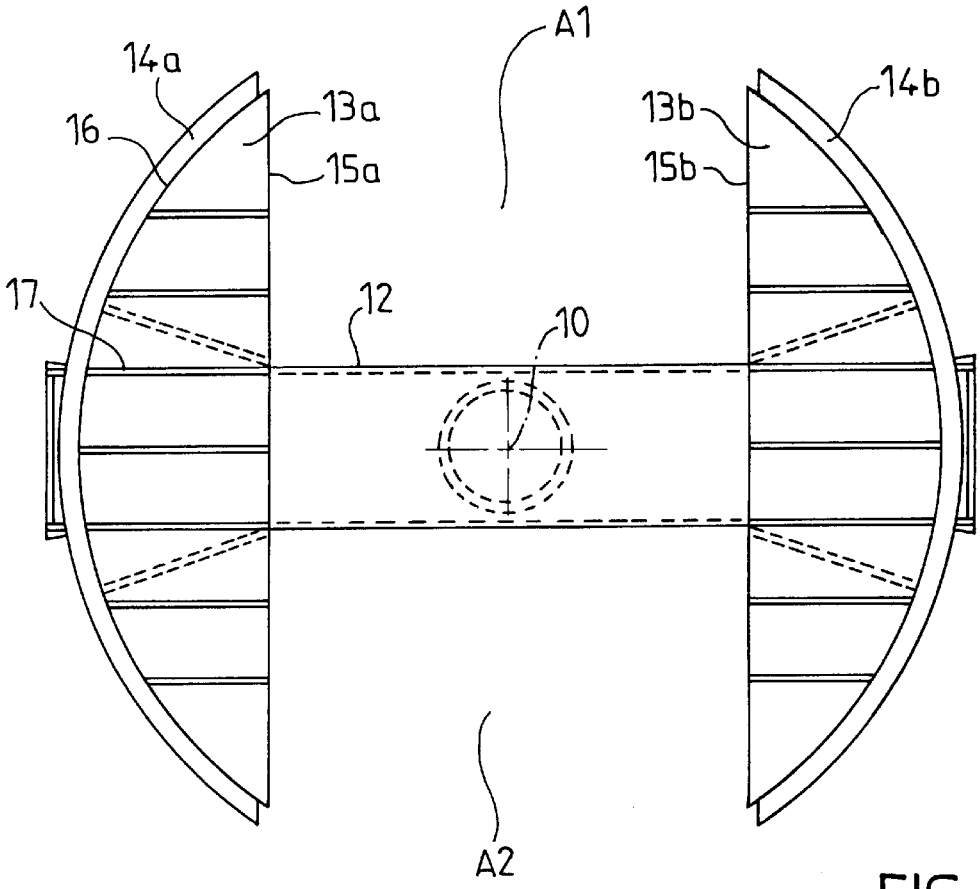

As represented in FIGS. 7, 8 and 9, the rotary frame 1 builds a mechanically welded assembly comprising a tubular shaft 11 fastened, at one of its ends, to a flange 13 perpendicular to the axis 10 of the shaft 11, and two plates 12, 12' parallel to one another and to the axis 10, welded to the flange 13 and to the central shaft 11, respectively along two diametrically opposed generating lines. Each plate 12, 12' builds a supporting platform for a motor-mandrel assembly 2, 2' carrying a mandrel 21, 21' extending in cantilever fashion on the opposite side, passing through an opening in the flange 13.

On the reeling side, the frame 1 rests on two spaced rollers 41, 41' mounted rotatably around horizontal axes on a fixed bracket 4, via a circular bearing track 14 provided on the periphery of the flange 13.

At its opposite end, the central shaft 11 is supported by a bearing 42 mounted on a fixed base 43 provided on the foundation block and whose axis is placed at the level required with respect to the rollers 41, 41' such as the axis 10 of the central shaft 11 is substantially horizontal.

Along the bearing track 14 has been fastened a toothed crown 44 to which meshes a gear 41' closely attached to one of the bearing rollers 41 and driven into rotation by an auxiliary motor 45 which thus controls the pivoting motion of the frame 1 around the axis 10 for indexing one of the mandrels 21, 21' to the reeling position.

In order to maintain the frame 1 in both its angular positions, the flange 13 is fitted with two stops 18, diametrically opposed, cooperating with a removable locking device 46 made up, for instance, of two articulated jaws 46 mounted on the fixed support 4 and actuated by jacks.

However, in the preferred embodiment represented in the various figures, the flange 13 comprises two walls 13*a*, 13*b* welded to the plates 12, 12', perpendicular to the axis 10 and forming two spaced circular segments, each delimited towards the inside by a rectilinear rim 15 and towards the outside by a circular rim 16, in order to provide two wide indentations A1, A2 in the flange 13. The locking stops 18 of the frame 1 are advantageously each constituted of two flats welded to the gussets 17 and projecting with respect to the track 14.

Each wall in the form of a segment 13*a*, 13*b* is reinforced by ribs and the stiffness of the assembly is ensured by four triangular or trapezoid gussets 17, each extending in the alignment of a plate 12, 12' on either side of the latter and welded, respectively, to the walls 13*a*, 13*b*.

The tube 11, both plates 12, 12' and both segments 13*a*, 13*b* thus build a rigid structure made of mechanically welded steel, comprising two compartments A1, A2 of rectangular section, each delimited by a plate 12, 12' and by the rectilinear rims 15*a*, 15*b* perpendicular to the latter of both pants and which can accommodate both motor-mandrel assemblies 2, 2'.

Figure 10:
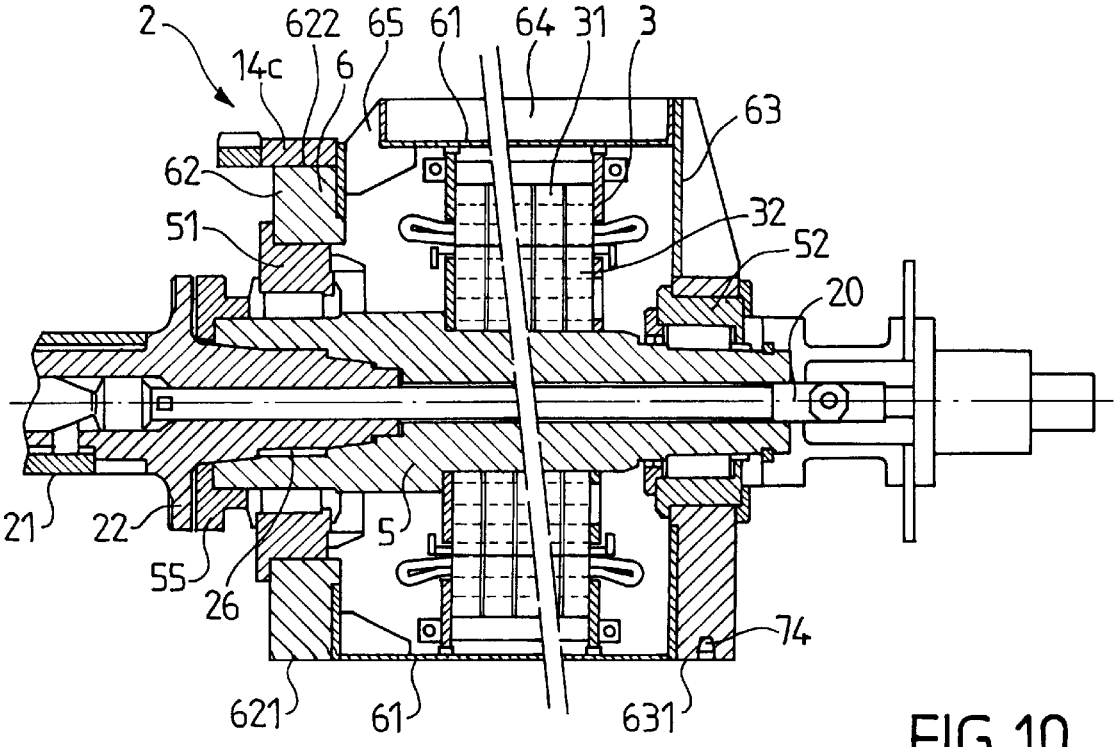
FIG. 10 is a detail view, in axial section, of another embodiment of a motor-mandrel assembly.

As can be seen particularly in FIG. 10, each motor-mandrel assembly 2 comprises a rotation shaft 5 on which is fastened in cantilever fashion the mandrel 21 and which is brought into rotation by a motor 3 located in a rigid chassis 6 in the form of a cage, comprising a cylindrical side wall 61 to which are fastened the stator 31 of the motor 3 and a front flange 62 and a rear flange 63. The rotor 32 of the motor 3 is fixed to the rotation shaft 5 itself supported by two bearings 51, 52 mounted respectively in circular openings centered on the axis 20 of the assembly and arranged respectively on both flanges 62, 63 of the chassis 6. The assembly forms a rigid structure to maintain, during operation, the shaft 5 carrying the mandrel 21, the side wall 61 itself being reinforced by radiating ribs 64.

Figure 4:
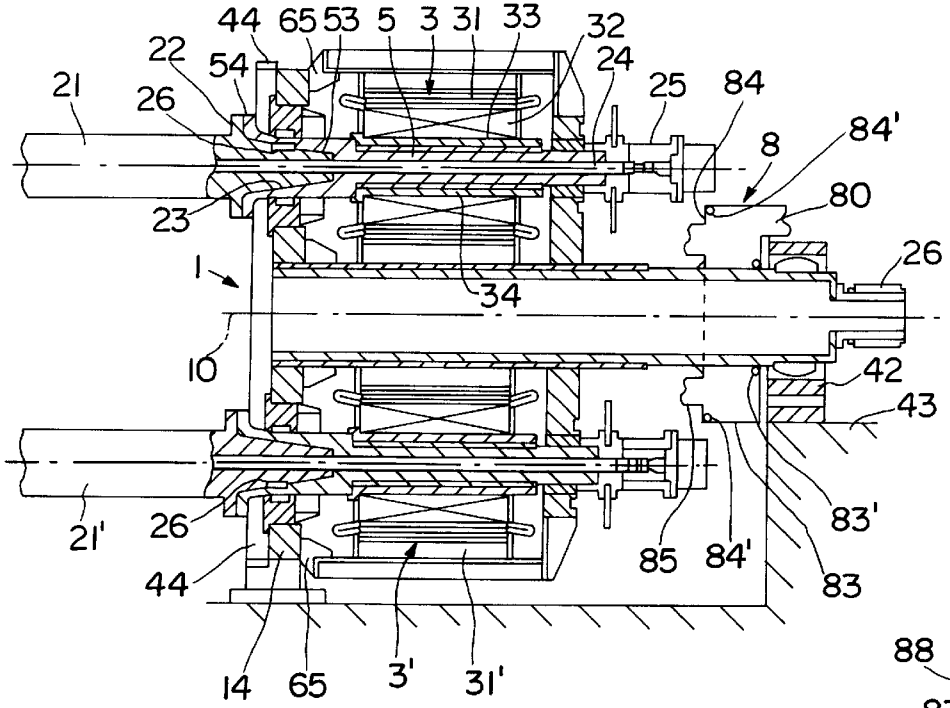
FIG. 4 is a longitudinal sectional view, along line IV—IV of FIG. 2.
Figure 6:
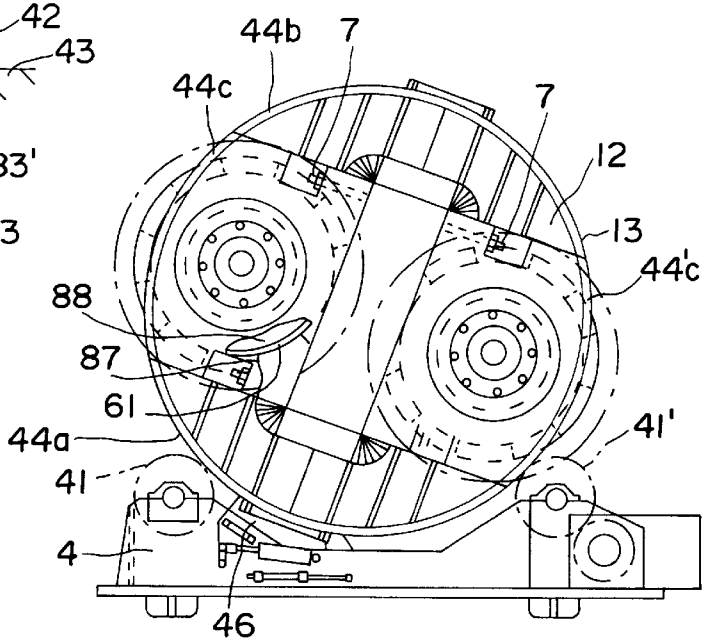
FIG. 6 is a front view in the direction of arrow VI of FIG. 1.
Figure 5:
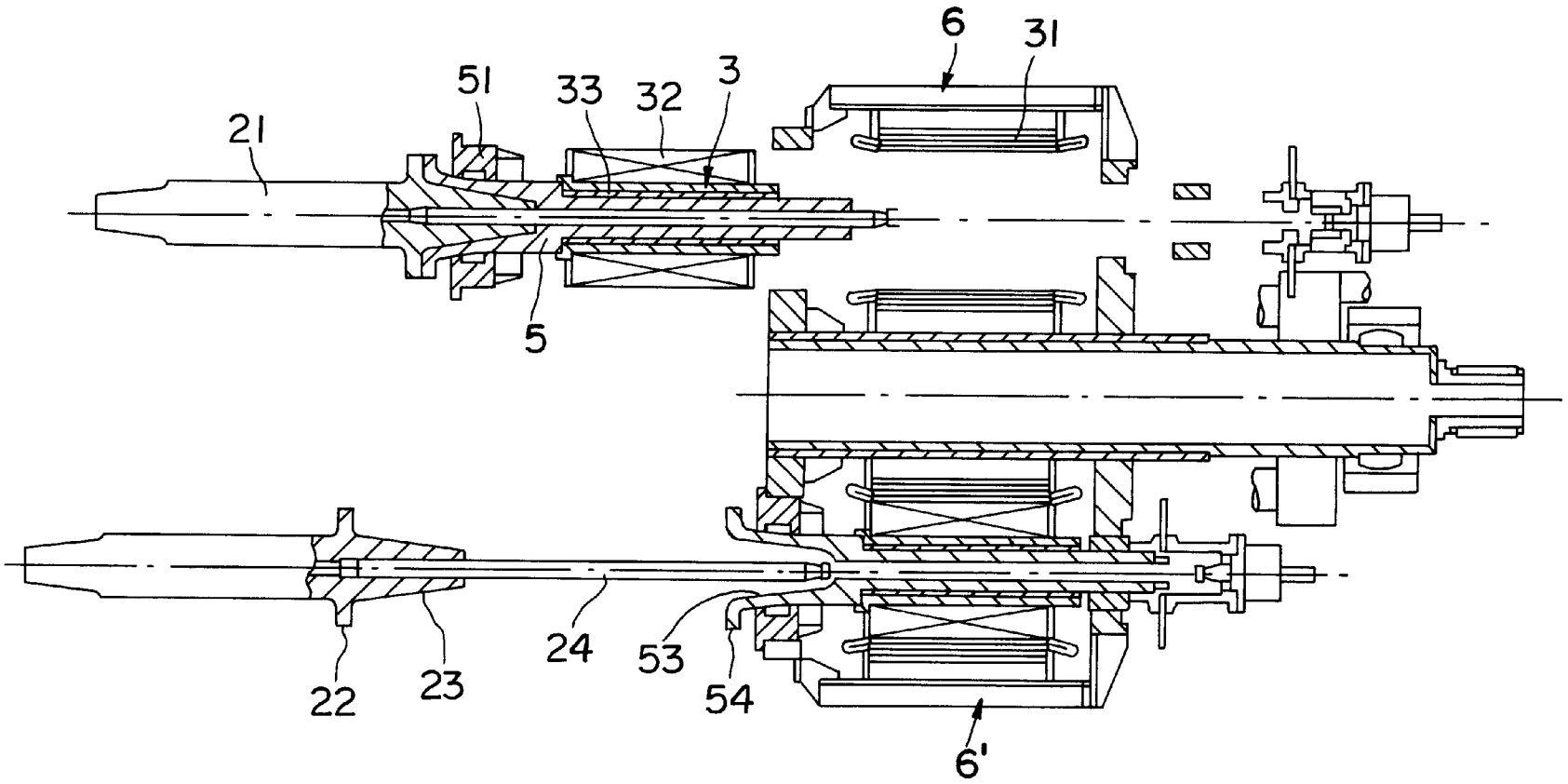
FIG. 5 is a longitudinal sectional view after partial removal of the mandrels or of the motors.

Front flange 62 and rear flange 63 of the chassis 6 are provided, respectively, with rectilinear sides 621, 631 placed in a same plane parallel to the axis 20, which define a plane base for the chassis 6, able to be applied to one of the platforms 12, 12' when the motor-mandrel assembly is placed in the corresponding compartment A1, A2 in the manner represented particularly in FIGS. 4 and 5.

The chassis 6 of each motor-mandrel assembly 2, 2' can be fixed removably on the corresponding platform 12, 12' simply by four bolts enabling fast assembly and disassembly.

Thus, each motor-mandrel assembly comprising a chassis 6 carrying the motor 3, its rotation shaft 5 with both bearings thereof and, possibly, a mandrel 21 fixed at the end of the shaft, provide an interchangeable coiling module which can be mounted in either compartment A1 or A2 of the central frame 1, which is perfectly symmetrical.

In the preferred example represented in the figures, the bolts 7 used for fastening the chassis 6 are placed at the four angles of each supporting platform 12, 12' and extend vertically so as to engage in corresponding bores 71 provided at the base of both flanges 62, 63 of the chassis 6, symmetrically on either side of the middle plane passing through the axis 20.

As shown in FIG. 2, the rear flange 63 is simply provided with a widened base so that the bolts 7 engaging in bores 71 provided at both ends of the former reach outside to enable the fitting of tightening nuts 72.

Figure 11:
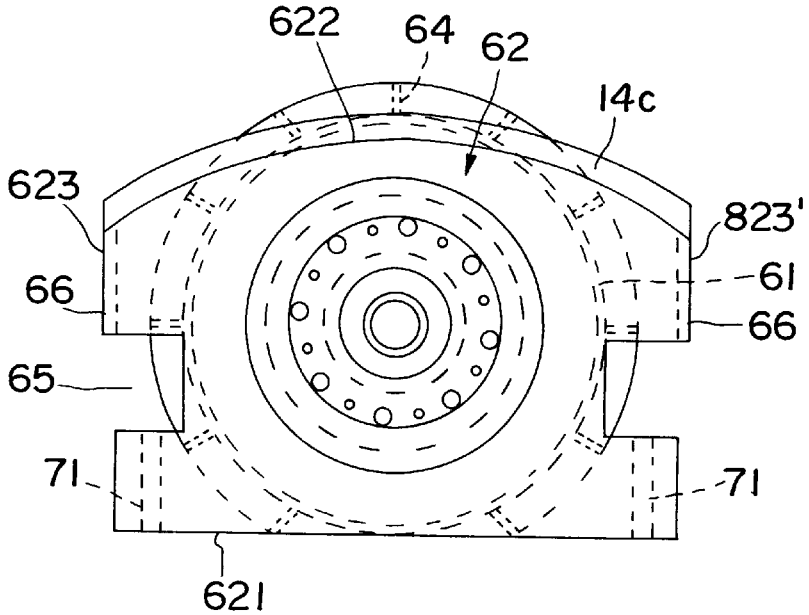
FIG. 11 is a front elevation view of the chassis of a motor-mandrel assembly.

Conversely, the front flange 62 represented in FIG. 11 comprises two lateral sides 623 perpendicular to the lower side 621 and in which indentations 65 have been provided.

At least on one portion of their height, for instance above the indentations 65, the lateral sides 623, 623' are spaced apart from one another over a distance slightly greater than the distance between the rims 15*a*, 15*b* of both segments and are provided with grooves 66 engaging onto the segments to ensure centering of the chassis and its attachment with the flange 13 when fitting the chassis 6 onto the platform 12. The heads of the bolts 7 reach into the indentations 65 to enable tightening of the bolts 72.

Preferably, the fastening platform 12 is provided, on the side opposite to the mandrels, with a central pin 18 placed in the middle plane passing through the axis 10 and engaging in a corresponding bore of the rear flange 63 of the chassis 6 in order to guarantee centering of the latter on the plate 12 in a position in which the axis 20 of the mandrel 21 and of the rotation shaft 5 is strictly parallel to the central axis 10 of the rotary frame 1 in the working position of the motor-mandrel assembly.

Besides, the upper side 622 of the front flange 62 opposite to the base 621, has a circular profile of the same radius as the external rims 16*a*, 16*b* of both segments 13*a*, 13*b* so as to form a circular flange after fitting the chassis 6, 6' into the openings A1, A2.

The bearing track 14 thus comprises four sections, namely two fixed sections 14*a*, 14*b* and two mobile sections 14*c*, 14'*c* each constituted of a curved-in profile in the fort of a circular sector and fastened respectively along the external sides 16*a*, 16*b* of both segments 13*a*, 13*b* and on the curved-in side 622 of the chassis 6 of each motor-mandrel assembly 2, 2'. The fixed and mobile sections connect tangentially to provide a continuous circular track 14 after fitting and fastening of the chassis 6, 6' of both motor-mandrel assemblies 2, 2' onto the platforms 12, 12' of the frame 1.

The toothed crown 44 is divided into two fixed sectors 44*a*, 44*b* and two mobile sectors 44*c*, 44'*c* fixed respectively along the four corresponding sections of the circular track 14 so as to be aligned with respect to one another and to form a circular crown 44 meshing with the pinion 41'.

The lightweight and the extreme simplicity of the central frame 1 in mechanically welded construction, after locking of the bolts 7, forms a compact assembly with the chassis 6, 6'. The latter must simply be reinforced sufficiently to form a structure, sturdy enough to provide the stiffness of the assembly.

As stated above, each motor-mandrel assembly forms an interchangeable module which can be removed as a block and taken to the workshop for maintenance.

However, according to other advantageous provisions of the invention, each motor-mandrel assembly is offered in a version enabling easy dismantling of the various parts, either in a workshop or directly from the coiler, as represented schematically in FIGS. 4 and 5 which are longitudinal sectional views through an axial plane showing the coiler assembly and the disassembly modalities of certain parts.

Each mandrel 21, which can be of a known type, is provided at its base with a fastening plate 22 followed by a centering cone 23 able to engage into a corresponding conical recess 53 of the rotation shaft 5, which has a flared end so as to form a flange 54 on which the fastening plate 22 of the mandrel can be applied, while the entire assembly is screwed together conventionally.

Keys 26 engaging into corresponding grooves of the conical recess 53 ensure proper attachment for the rotation of the centering cone 23 with the rotation shaft 5.

Conventionally, the shaft 5 is provided with an axial bore traversed by a rod 24 for controlling the maneuvers of the mandrel, actuated by a control mechanism 25 fixed on the rear end of the shaft 5.

The centering cone 23 advantageously is quite short so that the corresponding conical space 53 of the shaft 5 extends over a portion of the latter, corresponding substantially to the inside of the front bearing 51 so as not to reduce the stiffness of the central section of the shaft 5 carrying the rotor 32 of the motor 3.

In the case of FIGS. 4 and 5, where the mandrel 21 is fastened by the plate 22 on a flange 54, the latter locks the front bearing 51 which, if required, must then be removed from the rear. This is the reason why the rotor 32 of the motor is shrunk on a tubular sleeve 33 inserted into the central section of the shaft 5. Ribs 34 are provided on the sleeve 33 to engage into corresponding grooves of the shaft 5 in order to provide proper attachment for the rotation of the rotor 32 with the shaft 5.

Besides, the front bearing 51 is housed in an opening provided in the front flange 62 whose diameter must be slightly greater than the diameter of the rotor 32 to allow passage of the latter.

Thus, it is possible to dismantle from the front, for maintenance purposes, the shaft assembly 5 carrying the rotor 32, the front bearing 51 and the mandrel 21, whereas the chassis 6 remains fastened to the frame 1 with the stator 31 as indicated in FIG. 5.

However, as represented for the lower assembly 2', it is also possible to leave in the chassis 6 the assembly consisting of the motor 3 and of the shaft 5, while removing only the mandrel 21', for instance to replace it with a mandrel type or of another size.

The coiler represented in FIGS. 4 and 5 is suited to the coiling of products of very small thickness, for instance sheet iron.

However, thanks to the use of interchangeable modules, the installation can be adapted to the coiling of stiffer products, for example thin steel sheets, without modifying the carrying frame 1. The assembly of each motor-mandrel assembly is simply suited to the loads that the coiler has to sustain.

Particularly, not to reduce excessively the cross section of the central part of the shaft 5, the rotor 32 can be shrunk directly on the shaft as represented in FIG. 10.

In such a case, the bearing 51 must be removed from the front and the fastening flange of the mandrel is provided on a separate ring 55 screwed on the font end of the shaft 5.

The use of a tube 11 to build the central shaft of the rotary frame 1 make it possible to pass inside this tube the electric supply cables for powering and controlling the motors 3, 3' as well as the pipework for the circulation of the hydraulic fluids for the expansion and shrinkage control of the mandrels as well as the lubrication of the bearings, which can be regrouped on the rear end of the central shaft 11 and linked to fluid supply means by a rotary gasket 27.

Also, the electric supply cables of the motors 3 are connected to a manifold 35 provided at the real end of the shaft 11, in the alignment of the hydraulic coupling 26.

Thus, it should be noted that asynchronous motors can be used for driving the mandrels. No supply need be provided for the rotors which, as seen previously, are fastened to the rotation shaft of each assembly and are dismantled together with the latter.

If the internal cross section of the tubular shaft 11 is sufficient, the latter can be used for forced ventilation of the motors, whereas the ventilation air is expelled into the central tube 11 and passes through corresponding openings provided in the tube 11, the fastening plate 12 and the wall 61 of the chassis in order to cool down the motor while exhausting via a ring-shaped space provided between the front flange 62 and the corresponding end of the side wall 61 which is connected to the front flange by gussets 65 located in the alignment of the ribs 64.

Figure 3:
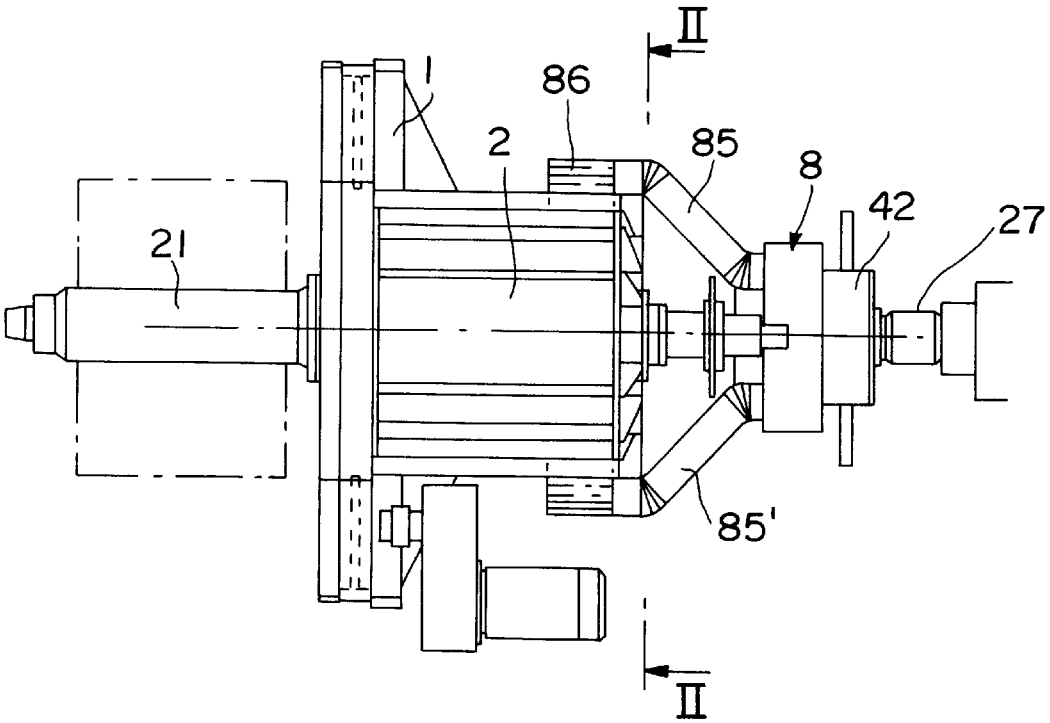
FIG. 3 is a top plan view of the coiler.

However, according to an embodiment represented in the figures, ventilation is ensured by a ring-shaped caisson 8 connected by sheaths 81 to the shells of two motors, as represented in FIGS. 3, 4 and 5, whereas the central tubular shaft 11 allows simply the passage of electric supply cables linked to the manifold 35 as well as hydraulic pipework connected to the rotary coupling 26.

The ventilation caisson 8, which is fixed in rotation, is delimited by a tubular side wall 82 and two flanges 83, 84 each provided with a central opening for passing the shaft 11.

The rear flange 83 is attached to the wall 82 and connected to a sliding gasket 83' providing the necessary tightness with the shaft 11.

The front flange 84 is fixed on the shaft 11 and thus rotates with the latter. Therefore, it is provided on its periphery with a ring-shaped gasket 84' applied against the wall 82 to provide the necessary tightness.

The caisson 8 exhibits a ventilation circuit reaching to an opening 80 provided on the rear flange 83 or the side wall 82.

On the front flange 84, rotating with the shaft 11, are provided two openings, diametrically opposite to one another, on which are connected two sheaths 85, 85' leading to two side caissons 86, 86' fixed respectively on the platforms 12, 12' on either side of the central axis 10 and each provided with two branches leading to the base of both compartments A1, A2 in which are inserted the chassis 6 of both motor-mandrel assemblies.

Each branch 86 is provided with a curved-in exhaust end 87 on which the chassis 6 of a motor-mandrel assembly is applied, during the fitting of the former and leading to an opening 88 provided in the tubular wall 61, for instance between two ribs 64.

The pressurized air injected into the ring-shaped caisson 8 is thus discharged inside the chassis 6 of the motor and escapes through the ring-shaped space 65 provided between the external wall 61 and the front flange 62 of the chassis 6.

If the use of asynchronous motors for controlling the rotation of the mandrels of the electric motors enables simplification of the power supply, other types of motor could also be used. Besides, these motors could also be actuated by hydraulic or pneumatic energy, providing the power necessary to the coiling operation can be obtained.

While it is particularly advantageous to fasten each motor-mandrel assembly oil a single platform using four bolts, the supporting devices of the reducing gear assemblies could be made in another way.

It would also be possible, if needed, to provide a coiler carrying more than two motor-mandrel assemblies, whereas the rotary frame can, for instance, be provided with three platforms, offset by a 120° angle.

Also, other provisions could be contemplated for the assembly of the motor, particularly the embodiment of the rotation shaft and of the bearings, the fastening of the mandrel and its control system, and any type of mandrel can be used.

What we claim is:

1. A turntable coiler for the reeling of a strip product on one of at least two reeling mandrels, comprising a rotary frame mounted rotatably on a fixed bracket for rotation around a central axis, at least two reeling mandrels fixed in cantilever manner each fastened to and aligned with a rotation shaft mounted rotatably on two spaced centering bearings supported by the rotary frame and defining a reeling axis of a corresponding mandrel parallel to the central axis of the frame and eccentric with respect to the latter, and at least two motors each connected to a respective mandrel and each comprising each a rotor and a stator centred around the reeling axis, means for controlling the rotation of the frame around the central axis for selective indexing of one of the mandrels in reeling position and means to supply each motor with power in order to drive the corresponding mandrel, wherein each motor connected to a mandrel is mounted in an individual chassis on which are mounted the stator of the motor and both centring bearings of the rotation shaft so that each mandrel, the corresponding rotation shaft and the motor connected thereto constitute an independent motor-mandrel assembly, and the rotary frame is provided with at least two supporting devices of such a motor-mandrel assembly, each connected to removable means for removably centring and fastening each chassis in a position for which the reeling axis defined by the bearings is parallel to the central axis, whereas each motor-mandrel assembly thus constitutes an interchangeable module.

2. A coiler according to claim 1, wherein the chassis of each motor-mandrel assembly comprises a base which is substantially plane and able to be applied onto a corresponding platform provided on the rotary frame and constituting the supporting device of the corresponding motor-mandrel assembly, whereas the said base and the said platform are provided with combined centring and fastening devices, which can be disconnected from one another.

3. A coiler according to claim 2, wherein the rotary frame comprises a central shaft mounted pivotably on the fixed bracket around an axis and on which are fastened rigidly at least said two platforms arranged symmetrically on either side of the said central shaft and each constituting the supporting device of a motor-mandrel assembly.

4. A coiler according to claim 1, wherein the rotary frame comprises at least one flange fastened to one end of a central shaft perpendicular to the latter and on which is provided a circular bearing track centerd on the axis of the central shaft and rolling over at least two spaced rollers mounted rotatably on the fixed bracket each around an axis parallel to the central axis of the frame.

5. A coiler according to claim 4, wherein the central shaft is connected to a single rotary bearing flange fastened to one of the ends of the central shaft oriented towards the mandrels, whereas the other end is supported by a bearing mounted on a fixed bracket, located at a certain distance so that the axis of the shaft is horizontal.

6. A coiler according to claim 4, wherein the bearing flange is provided with at least two indentations each connected to a supporting device and each of a breadth at least sufficient to allow passage of a mandrel when fitting a motor-mandrel assembly to the said supporting device and that the circular bearing track comprises at least two fixed sectors provided on both parts of the bearing flange and extending between the said indentations and at least two mobile sectors provided each on the chassis of a motor-mandrel assembly, whereas the said fixed and mobile sectors have the same curving radius in order to obtain a continuous circular bearing track upon completion of the fitting of the motor-mandrel assemblies on the corresponding supporting devices.

7. A coiler according to claim 6, wherein the rotary frame comprises two parallel plates fixed on either side of the central shaft and each forming a platform for the fastening of a chassis of a motor-mandrel assembly, and the bearing flange comprises two spaced parts in the shape of circular segments, whereas each part has an external circular rim on which are provided a fixed sector of the bearing track and an internal rim perpendicular to both parallel platforms and that the chassis of each motor-mandrel assembly comprises, on the mandrel side, a flange defined by two parallel rims perpendicular to the base of the flange and whose spacing corresponds to the breadth of the identation between the internal parallel rims of both bearing segments of the flange, whereas the internal parallel rims of the flange of each motor are provided with grooves, able to slidably engage onto the corresponding internal rims of both segments when fitting a motor-mandrel assembly on the corresponding platform of the frame.

8. A coiler according to claim 7, wherein each platform is provided with a centring device cooperating with a combined device provided on a rear flange of each motor for the centring of the motor-mandrel assembly on the platform in a position for which the axis of the rotation shaft is strictly parallel to the axis of the frame.

9. A coiler according to claim 1, wherein each mandrel is provided with a fastening plate able to be applied onto a flange provided at a front end of the rotation shaft.

10. A coiler according to claim 9, wherein the flange is made up of a flared section provided on the corresponding end of the rotation shaft.

11. A coiler according to claim 9, wherein the flange is made up of a ring-shaped part fastened removably on the corresponding end of the rotation shaft.

12. A coiler according to claim 1, wherein each mandrel is provided, at one fastening end on the rotation shaft, with a conical centring part able to engage into a corresponding conical recess of the rotation shaft and said conical recess extending over a length such that the conical recess covers substantially the same length as the corresponding bearing of the shaft, whereas combined devices for proper attachment during rotation are interposed between the said centring part and the conical recess.

13. A coiler according to claim 1, wherein the rotor of each motor is shrunk on a tubular sleeve able to be inserted onto the rotation shaft and provided with ribs cooperating with corresponding grooves of the shaft for attachment during rotation of the latter with the sleeve and the rotor.

14. A coiler according to claim 1, wherein the rotor is shrunk directly on the rotation shaft.

15. A coiler according to claim 1, wherein a central shaft of the frame comprises a tube in which are provided circuits for supplying power to the motors and for controlling the mandrels.

16. A coiler according to claim 1, wherein the chassis of each motor forms a stiff carcass comprising a front flange and a rear flange carrying respectively both bearings of the rotation shaft and linked by a tubular wall provided with reinforcement fins and on which is fastened the stator of each motor.

17. A coiler according to claim 16, wherein a front bearing of the rotation shaft oriented to the mandrel side is housed in an opening provided in the front flange of the chassis and having a diameter slightly greater than that of the rotor to allow drawing, in a single motion, of the shaft with the said rotor through the said opening.

18. A coiler according to claim 16, wherein a space is left between one of the flanges of the chassis and the corresponding end of the tubular wall, at least on a portion of the periphery of the latter, to allow exhaust of the cooling air injected inside the said chassis through at least one inlet opening provided in the said tubular wall and able to be connected, when fitting the chassis, to a circuit carried by the frame and in which the cooling air is discharged.

19. A coiler according to claim 18, wherein, when fitting a chassis to the frame, the inlet opening is applied to a corresponding opening provided on a central tubular shaft of the frame and inside which the cooling air is discharged.

20. A coiler according to claim 18, wherein the frame is associated with a ring-shaped caisson surrounding an end of a central shaft opposite to a bearing flange and comprising a fixed section provided with an opening allowing inlet of pressurised air and a mobile section fixed on the central shaft, with interposition of sliding gaskets between the fixed and mobile sections and that the said mobile section is provided with at least one exhaust opening on which is connected at least one sheath carried by the frame and having an exhaust end against which is applied the air inlet opening of the chassis when fitting the latter onto the frame.

* * * * *